US011250809B2

(12) United States Patent
Chu et al.

(10) Patent No.: US 11,250,809 B2
(45) Date of Patent: Feb. 15, 2022

(54) CONFIGURATION INFORMATION SETTING METHOD AND COMPONENT, AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventors: Yifang Chu, Beijing (CN); Hao Zhu, Beijing (CN); Xin Duan, Beijing (CN); Jieqiong Wang, Beijing (CN); Ming Chen, Beijing (CN); Xibin Shao, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 136 days.

(21) Appl. No.: 16/618,448

(22) PCT Filed: Jun. 4, 2018

(86) PCT No.: PCT/CN2018/089755
§ 371 (c)(1),
(2) Date: Dec. 2, 2019

(87) PCT Pub. No.: WO2018/223919
PCT Pub. Date: Dec. 13, 2018

(65) Prior Publication Data

US 2020/0118518 A1 Apr. 16, 2020

(30) Foreign Application Priority Data

Jun. 9, 2017 (CN) ..... 201710434608.9

(51) Int. Cl.
*G09G 5/00* (2006.01)

(52) U.S. Cl.
CPC ..... *G09G 5/006* (2013.01); *G09G 2310/08* (2013.01); *G09G 2354/00* (2013.01)

(58) Field of Classification Search
CPC ..... G09G 5/006; G09G 2310/08; G09G 2354/00; G09G 2320/0693;
(Continued)

(56) References Cited

U.S. PATENT DOCUMENTS 8,629,826 B2 * 1/2014 Liao ..... G09G 3/3696 345/96
2007/0171161 A1 7/2007 Lin
(Continued)

FOREIGN PATENT DOCUMENTS

CN 1707595 A 12/2005
CN 101004902 A 7/2007
(Continued)

OTHER PUBLICATIONS

Search Report from European Application No. 18814297.0 dated Feb. 2, 2021.
(Continued)

*Primary Examiner* — Patrick N Edouard
*Assistant Examiner* — Joseph P Fox
(74) *Attorney, Agent, or Firm* — Calfee, Halter & Griswold LLP

(57) ABSTRACT

A configuration information setting method including: receiving a user-triggered information setting indication; generating, according to the information setting indication, an information setting instruction including setting indication data, the setting indication data configured to instruct the source driver to set configuration information of the source driver according to the setting indication data; and transmitting the information setting instruction to the source driver via the first signal line.

15 Claims, 7 Drawing Sheets

(58) Field of Classification Search
CPC ..... G09G 2370/04; G09G 2370/045; G09G 2370/10; G09G 2370/14; G09G 2370/08; G09G 5/008; G09G 3/2096; G09G 3/36; G09G 3/3685
See application file for complete search history.

(56) References Cited

U.S. PATENT DOCUMENTS

| | | | | |
|---|---|---|---|---|
| 2011/0199369 | A1 | 8/2011 | Huang et al. | |
| 2012/0242628 | A1 | 9/2012 | Yuan et al. | |
| 2013/0038367 | A1 | 2/2013 | Yen | |
| 2014/0192097 | A1 | 7/2014 | Baek et al. | |
| 2017/0069257 | A1* | 3/2017 | Lee | G09G 5/005 |
| 2017/0132966 | A1* | 5/2017 | Lim | G09G 5/18 |
| 2018/0006101 | A1* | 1/2018 | Ha | H01L 27/32 |
| 2018/0122294 | A1* | 5/2018 | Do | G09G 3/3225 |

FOREIGN PATENT DOCUMENTS

| | | | |
|---|---|---|---|
| CN | 102184696 | A | 9/2011 |
| CN | 102930836 | A | 2/2013 |
| CN | 104715706 | A | 6/2015 |
| JP | 2011112971 | A | 6/2011 |

OTHER PUBLICATIONS

Search Report for International Application No. 2018/089755 dated Jul. 30, 2018.
First Office Action from Chinese patent application 201710434608.9 dated Oct. 9, 2020.

* cited by examiner

CONFIGURATION INFORMATION SETTING METHOD AND COMPONENT, AND DISPLAY DEVICE

CROSS-REFERENCE TO RELATED APPLICATIONS

This application is a 35 U.S.C. 371 national stage application of PCT International Application No. PCT/CN2018/089755, filed on Jun. 4, 2018, which claims the priority of Chinese Patent Application No. 201710434608.9, filed on Jun. 9, 2017, the entire disclosures of which are incorporated herein by reference.

TECHNICAL FIELD

The present disclosure relates to the field of display device manufacturing, and in particular, to a configuration information setting method and component, and a display device.

BACKGROUND

The point-to-point interface has been widely used in the communication between the timing controller (referred to herein as T-CON for short) and the source driver (referred to herein as SD for short) inside the display panel of the liquid crystal display because of its simple structure, variable transmission bandwidth, low power consumption and good electromagnetic interference (referred to herein as EMI for short) performance. The configuration information of the source driver needs to be set before data is communicated through the point-to-point interface between the timing controller (i.e., the transmitting end) and the source driver (i.e., the receiving end).

In the related art, the configuration information of the source driver is usually set by a peripheral circuit of the source driver. In order to complete the setting of the configuration information of the source driver, the peripheral circuit needs to be provided with elements such as a resistor and a capacitor.

SUMMARY

According to some exemplary embodiments, a configuration information setting method for a timing controller is provided. The timing controller is connected to a source driver via a first signal line. The method may comprise: receiving a user-triggered information setting indication; generating, according to the information setting indication, an information setting instruction including setting indication data, wherein the setting indication data is configured to instruct the source driver to set configuration information of the source driver according to the setting indication data; and transmitting the information setting instruction to the source driver via the first signal line.

In an exemplary embodiment, the method may further comprise: receiving a user-triggered clock calibration indication; generating a clock calibration instruction according to the clock calibration indication; and sequentially transmitting, via the first signal line, the clock calibration instruction and clock calibration data to the source driver, such that the source driver performs a clock calibration operation according to the clock calibration data.

In an exemplary embodiment, each configuration instruction comprises a preamble, a start identifier and an end identifier that are sequentially arranged. The configuration instruction comprises the information setting instruction or the clock calibration instruction. The preamble is configured to instruct a receiving end to perform clock and phase calibration. The start identifier is configured to indicate a start of data transmission. The end identifier is configured to indicate an end of the data transmission. Data bits are further provided between the start identifier and the end identifier in the information setting instruction, and the data bits are configured to carry the setting indication data.

In an exemplary embodiment, the preamble is obtained by Manchester coding of consecutive at least 8-bit binary 0s. The starting identifier comprises consecutive 2-bit binary 0s. Data carried by the data bits is data obtained by Manchester coding. The end identifier comprises consecutive 2-bit binary 1s.

In an exemplary embodiment, the setting indication data is configured to indicate at least one of a number of channels of ports, a matching resistance, a transmission rate, a scrambling function, a signal quality configuration parameter, or an identity of the source driver.

According to some exemplary embodiments, a configuration information setting method for a source driver is provided. The source driver is connected to a timing controller via a first signal line. The method may comprise: receiving, via the first signal line, a configuration instruction transmitted by the timing controller; extracting, when the configuration instruction is an information setting instruction, setting indication data in the information setting instruction, wherein the setting indication data is configured to instruct the source driver to set configuration information of the source driver according to the setting indication data; and setting the configuration information of the source driver according to the setting indication data.

In an exemplary embodiment, the configuration instruction comprises a preamble, a start identifier and an end identifier that are sequentially arranged. The preamble is configured to instruct a receiving end to perform clock and phase calibration. The start identifier is configured to indicate a start of data transmission. The end identifier is configured to indicate an end of the data transmission.

In an exemplary embodiment, the method may further comprise, after the receiving via the first signal line the configuration instruction transmitted by the timing controller: detecting whether the start identifier of the configuration instruction is followed by data bits, wherein the data bits are configured to carry the setting indication data; determining that the configuration instruction is an information setting instruction when the start identifier of the configuration instruction is followed by the data bits; and determining that the configuration instruction is a clock calibration instruction when the start identifier of the configuration instruction is not followed by the data bits.

In an exemplary embodiment, the method may further comprise: determining data received at an agreed time after receipt of the clock calibration instruction to be clock calibration data when the configuration instruction is a clock calibration instruction; and performing a clock calibration operation according to the clock calibration data.

In an exemplary embodiment, the setting indication data is configured to indicate a number of channels of ports of the source driver, and the data bits comprise consecutive 2-bit binary data. The setting the configuration information of the source driver according to the setting indication data may comprise: setting the number of channels of the ports of the source driver to a first value when the consecutive 2-bit binary data is 00; setting the number of channels of the ports of the source driver to a second value when the consecutive 2-bit binary data is 01; and setting the number of channels of the ports of the source driver to a third value when the consecutive 2-bit binary data is 10 or 11, wherein the first value, the second value, and the third value are different from each other.

In an exemplary embodiment, the setting indication data is configured to indicate a matching resistance, and the data bits comprise consecutive 3-bit binary data. The setting the configuration information of the source driver according to the setting indication data may comprise: setting the matching resistance of the source driver to a first value when the consecutive 3-bit binary data is 000; setting the matching resistance of the source driver to a second value when the consecutive 3-bit binary data is 001; setting the matching resistance of the source driver to a third value when the consecutive 3-bit binary data is 010; setting the matching resistance of the source driver to a fourth value when the consecutive 3-bit binary data is 011; setting the matching resistance of the source driver to a fifth value when the consecutive 3-bit binary data is 100; and setting the matching resistance of the source driver to a sixth value when the consecutive 3-bit binary data is 101, wherein the first value, the second value, the third value, the fourth value, the fifth value, and the sixth value are different from each other.

In an exemplary embodiment, the setting indication data is configured to indicate a transmission rate, and the data bits comprise consecutive 5-bit binary data. The setting the configuration information of the source driver according to the setting indication data may comprise: setting the transmission rate of the source driver to 540 megabits per second when the consecutive 5-bit binary data is 00000, and increasing the transmission rate of the source driver by 108 megabits per second each time the 00000 increases by 1-bit binary 1, wherein the transmission rate of the source driver does not exceed 3,456 megabits per second.

According to some exemplary embodiments, a configuration information setting component for a timing controller is provided. The timing controller is connected to a source driver via a first signal line. The configuration information setting component may comprise: a first receiver configured to receive a user-triggered information setting indication; a first generator configured to generate, according to the information setting indication, an information setting instruction including setting indication data, wherein the setting indication data is configured to instruct the source driver to set configuration information of the source driver according to the setting indication data; and a first transmitter configured to transmit the information setting instruction to the source driver via the first signal line.

In an exemplary embodiment, the configuration information setting component may further comprise: a second receiver configured to receive a user-triggered clock calibration indication; a second generator configured to generate a clock calibration instruction according to the clock calibration indication; and a second transmitter configured to sequentially transmit the clock calibration instruction and clock calibration data to the source driver via the first signal line, such that the source driver performs a clock calibration operation according to the clock calibration data.

In an exemplary embodiment, each configuration instruction comprises a preamble, a start identifier and an end identifier that are sequentially arranged, and the configuration instruction comprises the information setting instruction or the clock calibration instruction. The preamble is configured to instruct a receiving end to perform clock and phase calibration. The start identifier is configured to indicate a start of data transmission. The end identifier is configured to indicate an end of the data transmission. Data bits are further provided between the start identifier and the end identifier in the information setting instruction, and the data bits are configured to carry the setting indication data.

In an exemplary embodiment, the preamble is obtained by Manchester coding of consecutive at least 8-bits binary 0s. The starting identifier comprises consecutive 2-bit binary 0s. Data carried by the data bits is data obtained by Manchester coding. The end identifier comprises consecutive 2-bit binary 1s.

In an exemplary embodiment, the setting indication data is configured to indicate at least one of a number of channels of ports, a matching resistance, a transmission rate, a scrambling function, a signal quality configuration parameter, or an identity of the source driver.

According to some exemplary embodiments, a configuration information setting component for a source driver is provided. The source driver is connected to a timing controller via a first signal line. The configuration information setting component comprises: a receiver configured to receive, via the first signal line, a configuration instruction transmitted by the timing controller; an extractor configured to extract, when the configuration instruction is an information setting instruction, setting indication data in the information setting instruction, wherein the setting indication data is configured to instruct the source driver to set configuration information of the source driver according to the setting indication data; and a setter configured to set the configuration information of the source driver according to the setting indication data.

In an exemplary embodiment, the configuration instruction comprises a preamble, a start identifier and an end identifier that are sequentially arranged. The preamble is configured to instruct a receiving end to perform clock and phase calibration. The start identifier is configured to indicate a start of data transmission. The end identifier is configured to indicate an end of the data transmission.

In an exemplary embodiment, the configuration information setting component may further comprise: a detector configured to detect whether the start identifier of the configuration instruction is followed by data bits, wherein the data bits are configured to carry the setting indication data; a first determinator configured to determine that the configuration instruction is an information setting instruction when the start identifier of the configuration instruction is followed by the data bits; and a second determinator configured to determine that the configuration instruction is a clock calibration instruction when the start identifier of the configuration instruction is not followed by the data bits.

In an exemplary embodiment, the configuration information setting component may further comprise: a third determinator configured to determine data received at an agreed time after receipt of the clock calibration instruction to be clock calibration data when the configuration instruction is the clock calibration instruction; and an actuator configured to perform a clock calibration operation according to the clock calibration data.

In an exemplary embodiment, the setting indication data is configured to indicate a number of channels of ports, and the data bits comprise consecutive 2-bit binary data. The setter is configured to: set the number of channels of the ports of the source driver to a first value when the consecutive 2-bit binary data is 00, set the number of channels of the ports of the source driver to a second value when the consecutive 2-bit binary data is 01, and set the number of channels of the ports of the source driver to a third value when the consecutive 2-bit binary data is 10 or 11, wherein the first value, the second value, and the third value are different from each other.

In an exemplary embodiment, the setting indication data is configured to indicate a matching resistance, and the data bits comprise consecutive 3-bit binary data. The setter is configured to: set the matching resistance of the source driver to a first value when the consecutive 3-bit binary data is 000, set the matching resistance of the source driver to a second value when the consecutive 3-bit binary data is 001, set the matching resistance of the source driver to a third value when the consecutive 3-bit binary data is 010, set the matching resistance of the source driver to a fourth value when the consecutive 3-bit binary data is 011, set the matching resistance of the source driver to a fifth value when the consecutive 3-bit binary data is 100, and set the matching resistance of the source driver to a sixth value when the consecutive 3-bit binary data is 101, wherein the first value, the second value, the third value, the fourth value, the fifth value, and the sixth value are different from each other.

In exemplary an embodiment, the setting indication data is configured to indicate a transmission rate, and the data bits comprise consecutive 5-bit binary data. The setter is configured to: set the transmission rate of the source driver to 540 megabits per second when the consecutive 5-bit binary data is 00000, and increase the transmission rate of the source driver by 108 megabits per second each time the 00000 increases by 1-bit binary 1, wherein the transmission rate of the source driver does not exceed 3,456 megabits per second.

According to some exemplary embodiments, a display device is provided which comprises a timing controller and a source driver. The timing controller comprises the configuration information setting component for the timing controller. The source driver comprises the configuration information setting component for the source driver.

According to some exemplary embodiments, a computer-readable storage medium is provided which has stored therein instructions that, when executed on a computer, cause the computer to perform the configuration information setting method for the timing controller.

According to some embodiments of the present disclosure, a computer-readable storage medium is provided which has stored therein instructions that, when executed on a computer, cause the computer to perform the configuration information setting method for the source driver.

BRIEF DESCRIPTION OF THE DRAWINGS

In order to more clearly illustrate the technical solutions in embodiments of the present disclosure, the drawings used in the description of the embodiments will be briefly described below. The drawings in the following description are only some of the embodiments of the present application, and those skilled in the art can obtain other drawings based on these drawings without paying any inventive effort.

DETAILED DESCRIPTION

In the process of implementing the present disclosure, the inventors have found that the related art has at least the following problem: in order to complete the setting of the configuration information of the source driver, the peripheral circuit needs to be provided with elements such as a resistor and a capacitor, resulting in a complicated structure of the peripheral circuit. To solve the problem that the structure of the peripheral circuit in the related art is complicated, exemplary embodiments provide a configuration information setting method and component and a display device.

To render more apparent the objective, the technical solutions and the advantages of the present application, exemplary embodiments will be further described in detail below with reference to the accompanying drawings.

Figure 1A:
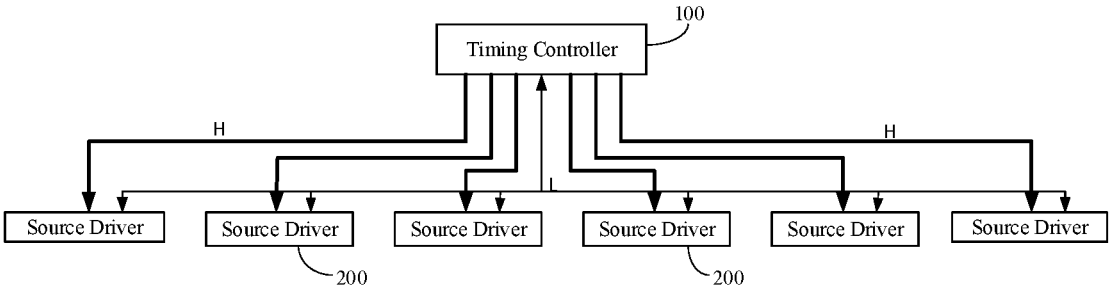
FIG. 1A is a schematic diagram of a display device in which a configuration information setting method according to an exemplary embodiment is used.
Figure 1B:
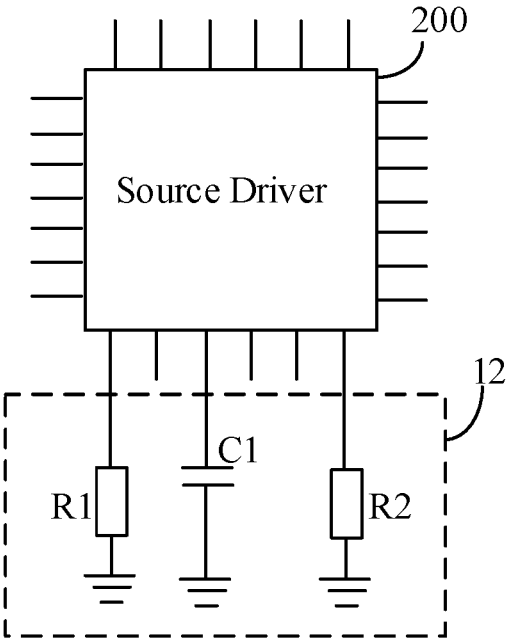
FIG. 1B is a schematic diagram of a structure of a peripheral circuit of a source driver in the related art.

FIG. 1A shows a schematic diagram of a display device in which a configuration information setting method according to an exemplary embodiment is used. As shown in FIG. 1A, the display device may include a timing controller 100 and a plurality of source drivers 200. In the display device, there generally exists two kinds of signal lines, for example, first signal lines L and second signal lines H. The signal transmission rate of the first signal lines is smaller than that of the second signal lines. The first signal lines may be referred to as low speed signal lines, and the second signal lines may be referred to as high speed signal lines. A plurality of second signal lines H of the timing controller 100 are connected in one-to-one correspondence with the plurality of source drivers 200, and the timing controller 100 is further connected, through a first signal line L, to the plurality of source drivers 200 that are connected in parallel. In the related art, the first signal line L is generally used to perform a clock calibration operation only. Therefore, the setting of the configuration information of the source driver is generally completed by the peripheral circuit of the source driver. The peripheral circuit needs to be provided with elements such as a resistor and a capacitor in order to complete the setting of the configuration information of the source driver. FIG. 1B exemplarily shows a schematic diagram of a structure of a peripheral circuit 12 for setting configuration information of the source driver 200. As shown in FIG. 1B, the peripheral circuit 12 is provided with a resistor R1, a resistor R2, and a capacitor C1. As can be seen, in the related art, the setting of the configuration information necessitates a complicated structure of the peripheral circuits.

In an exemplary embodiment, the first signal line L can complete the setting of the configuration information of the source driver in addition to the clock calibration operation. For example, the first signal line L can be used to set the number of channels of the ports of the source driver to be, for example, 1, 2 or 3, etc. As another example, the first signal line L can be used to set the transmission rate of the source driver to be, for example, 540 Mbps (megabits per second), 648 Mbps, and the like. In an exemplary embodiment, since the first signal line can be used to complete the setting of the configuration information of the source driver, the peripheral circuit does not need to complete the setting of the configuration information of the source driver, and does not need to be provided with elements such as a resistor and a capacitor. Thus, the structure of the peripheral circuit is simpler.

An exemplary embodiment provides a configuration information setting method used in a panel driving circuit 02 of the display device 10 as shown in FIG. 1A. The configuration information setting method will be described below by way of example with the timing controller and the source driver included in the panel driving circuit 02, respectively.

Figure 1C:
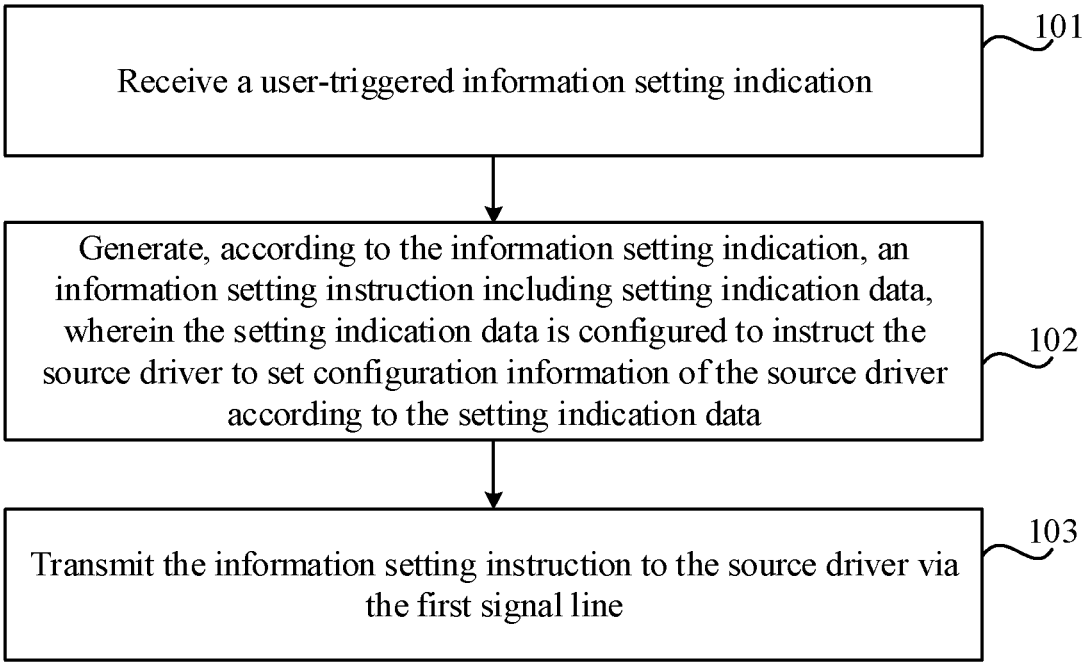
FIG. 1C is a flow chart of a configuration information setting method according to an exemplary embodiment.

FIG. 1C is a flow chart of a configuration information setting method according to an exemplary embodiment. This method is used, for example, in the timing controller 100 as shown in FIG. 1A. As shown in FIG. 1C, the method may include, at step 101, receiving a user-triggered information setting indication. The method may further include, at step 102, generating an information setting instruction including setting indication data according to the information setting indication. The setting indication data is used to instruct the source driver to set the configuration information of the source driver according to the setting indication data. The source driver can be any of the source drivers as shown in FIG. 1A. The method may further include, at step 103, transmitting an information setting instruction to the source driver via the first signal line.

In summary, in the configuration information setting method used in the timing controller provided by exemplary embodiments, the timing controller can generate an information setting instruction including the setting indication data according to the information setting indication triggered by the user, and send the information setting instruction to the source driver via the first signal line, thereby enabling the source driver to set the configuration information of the source driver according to the setting indication data. The method eliminates the need for the peripheral circuit to complete the setting of the configuration information of the source driver, and the peripheral circuit does not need to be provided with elements such as a resistor and a capacitor, thereby simplifying the structure of the peripheral circuit and making the setting of configuration information of the source driver more flexible.

Figure 1D:
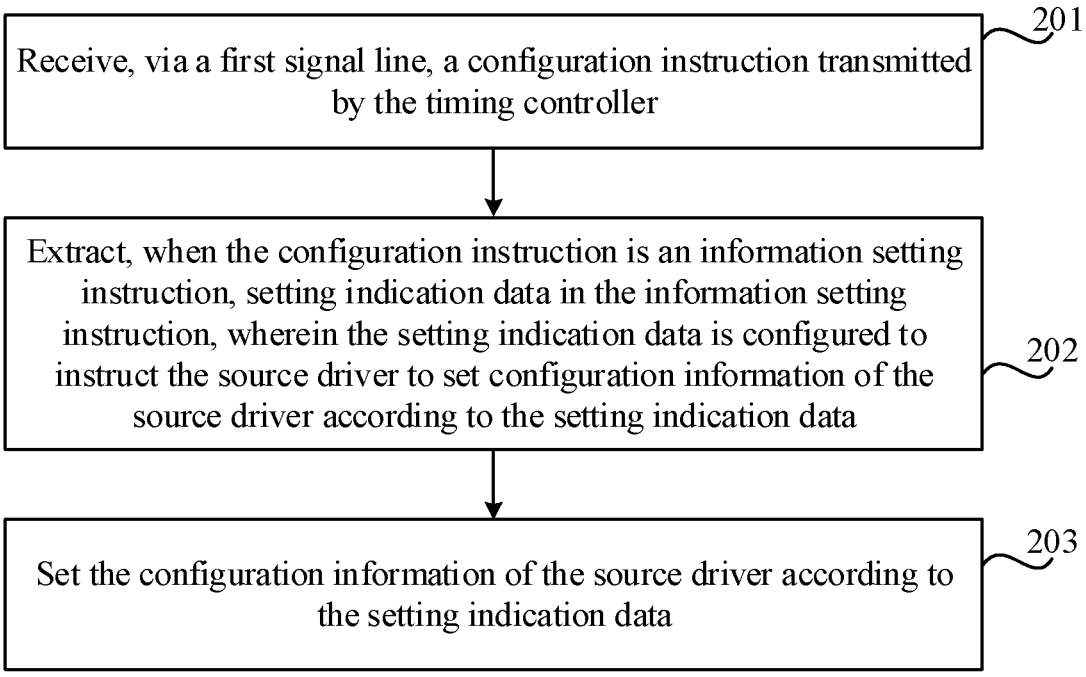
FIG. 1D is a flow chart of a configuration information setting method according to an exemplary embodiment.

FIG. 1D is a flow chart of a configuration information setting method provided by an exemplary embodiment. This method is used, for example, in the source driver 200 as shown in FIG. 1A. As shown in FIG. 1D, the method may include, at step 201, receiving a configuration instruction transmitted by the timing controller via the first signal line. The method may further include, at step 202, extracting, when the configuration instruction is an information setting instruction, setting indication data in the information setting instruction. The setting indication data is used to instruct the source driver to set the configuration information of the source driver according to the setting indication data. The method may further include, at step 203, setting the configuration information of the source driver according to the setting indication data.

In summary, in the configuration information setting method used in the source driver provided by some exemplary embodiments, the source driver can receive the configuration instruction transmitted by the timing controller via the first signal line, extract the setting indication data when the configuration instruction is the information setting instruction, and then set the configuration information of the source driver according to the setting indication data. The method eliminates the need for the peripheral circuit to complete the setting of the configuration information of the source driver, and the peripheral circuit does not need to be provided with elements such as a resistor and a capacitor, thereby simplifying the structure of the peripheral circuit.

Figure 2A:
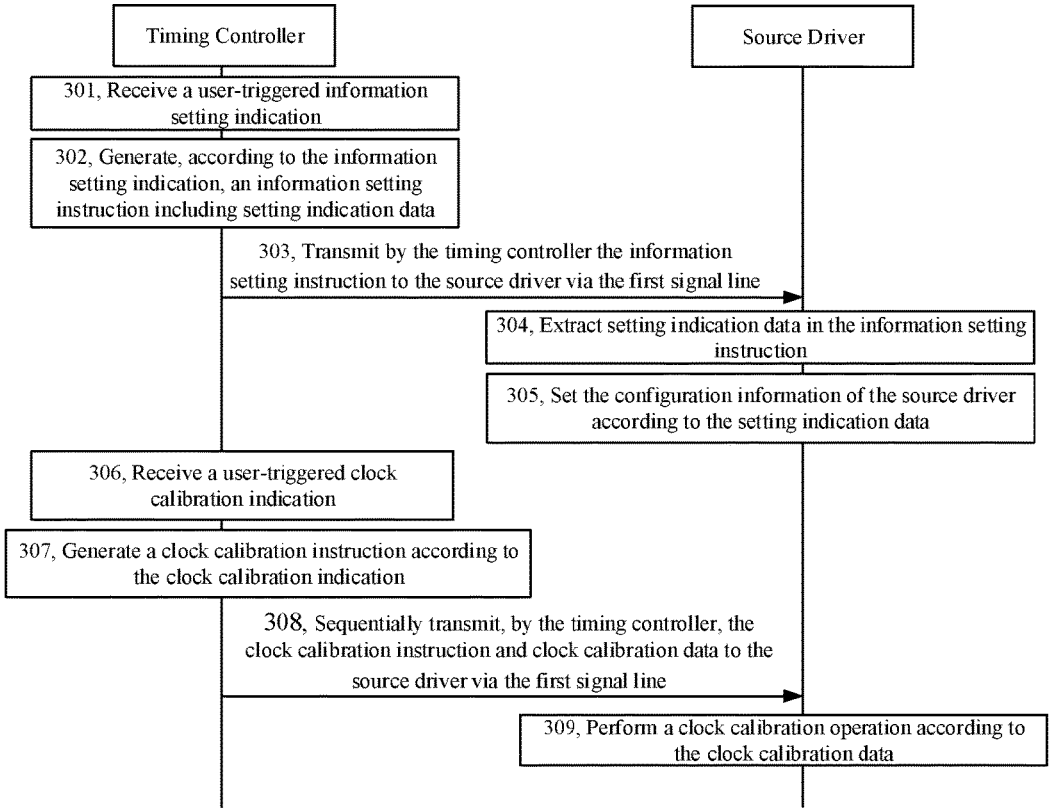
FIG. 2A is a flow chart of a configuration information setting method according to an exemplary embodiment.

An exemplary embodiment provides another configuration information setting method. This method is used, for example, for the timing controller 100 and the source driver 200 as shown in FIG. 1A. As shown in FIG. 2A, the method includes, at step 301, receiving by the timing controller a user-triggered information setting indication. The timing controller receives the information setting indication triggered by the user so as to generate an information setting instruction including setting indication data.

Moreover, the method may further include, at step 302, generating by the timing controller the information setting instruction including the setting indication data according to the information setting indication.

The setting indication data is used to instruct the source driver to set the configuration information of the source driver according to the setting indication data. The source driver is, for example, any of the source drivers in the display device 10 as shown in FIG. 1A.

By way of example, the setting indication data can be used to instruct the source driver to set at least one of the number of channels of ports, the matching resistance, the transmission rate, or other configuration information (such as a scrambling function, a signal quality configuration parameter, etc.) of the source driver according to the setting indication data. The configuration information to be set is not limited in the exemplary embodiment.

It should be noted that the timing controller may receive an information setting indication triggered by the user, or may receive a clock calibration indication triggered by the user. The timing controller generates a corresponding configuration instruction according to the indication received, which configuration instruction includes an information setting instruction or a clock calibration instruction. For example, when the timing controller receives the information setting instruction, the timing controller generates an information setting instruction including the setting indication data according to the information setting instruction. When the timing controller receives the clock calibration indication, the timing controller generates a clock calibration instruction according to the clock calibration indication.

Each of the configuration instructions generated by the timing controller may include a preamble, a start identifier, and an end identifier that are sequentially arranged. The preamble is used to instruct the receiving end to calibrate the clock and phase. The start identifier is used to indicate the start of data transmission. The end identifier is used to indicate the end of the data transmission. Data bits may further be provided between the start identifier and the end identifier in the information setting instruction, and the data bits are used to carry the setting indication data.

Figure 2B:
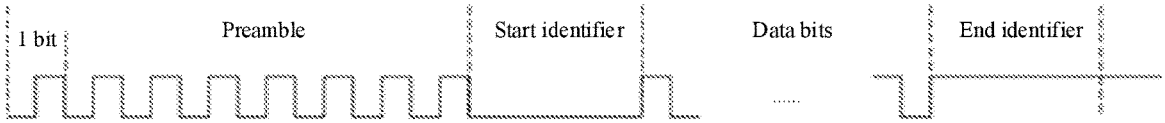
FIG. 2B is a schematic diagram of a format of an information setting instruction according to an exemplary embodiment.

By way of example, FIG. 2B shows a schematic diagram of the format of an information setting instruction. According to exemplary embodiments, the preamble may be obtained by Manchester coding of consecutive at least 8-bit binary 0s (or 1s). FIG. 2B is schematically illustrated with the preamble being obtained by Manchester coding of consecutive 8-bit binary 0s. According to the present disclosure, the start identifier may be kept as a low level signal without performing Manchester coding; for example, it may include consecutive at least 2-bit binary 0s. FIG. 2B is schematically illustrated with the start identifier being consecutive 2-bit binary 0s. The data carried by the data bits is data obtained by Manchester coding. The end identifier may be kept as a high level signal without performing Manchester coding; for example, it may include consecutive at least 2 bit binary 1s. FIG. 2B is schematically illustrated with the end identifier being consecutive 2-bit binary 1s. It should be noted that, in an embodiment, the start identifier may remain as a high level signal and the end identifier may remain as a low level signal.

Figure 2C:
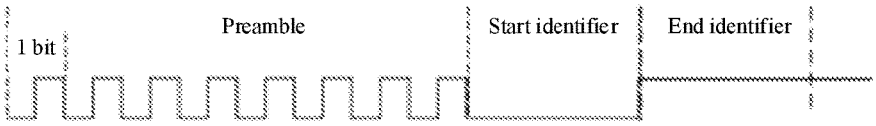
FIG. 2C is a schematic diagram of a format of a clock calibration instruction according to an exemplary embodiment.

By way of example, FIG. 2C shows a schematic diagram of the format of a clock calibration instruction. According to exemplary embodiments, the clock calibration instruction may include a preamble, a start identifier, and an end identifier that are sequentially arranged. The preamble can be obtained by Manchester coding of consecutive 8-bit binary 0s. The start identifier includes consecutive 2-bit binary 0s. The end identifier includes consecutive 2-bit binary 1s. Those skilled in the art will appreciate that the preamble, the start identifier, and the end identifier may also be represented by other binary values.

Returning to FIG. 2A, the method may further include, at step 303, transmitting by the timing controller an information setting instruction to the source driver via the first signal line, as shown in FIG. 2A.

It should be noted that the identity of the source driver on which a corresponding operation is to be performed may be transmitted together with the information setting instruction. After the source driver receives a signal transmitted by the timing controller, it can detect whether the identity in the signal is the same as its own identity. When the identity in the signal is the same as its own identity, the source driver performs the corresponding operation, such as setting the configuration information (steps 304 and 305, which will be described in detail later). When the identity in the signal is not the same as its own identity, the source driver does not perform the operation. The identity of the source driver is agreed on and configured in advance by the timing controller and the source driver.

The method can also include, at step 304, extracting by the source driver the setting indication data in the information setting instruction.

For the source driver, the source driver receives a configuration instruction transmitted by the timing controller via the first signal line. When the configuration instruction is an information setting instruction, the source driver extracts the setting indication data in the information setting instruction, and then sets the configuration information of the source driver according to the setting indication data.

Figure 2D:
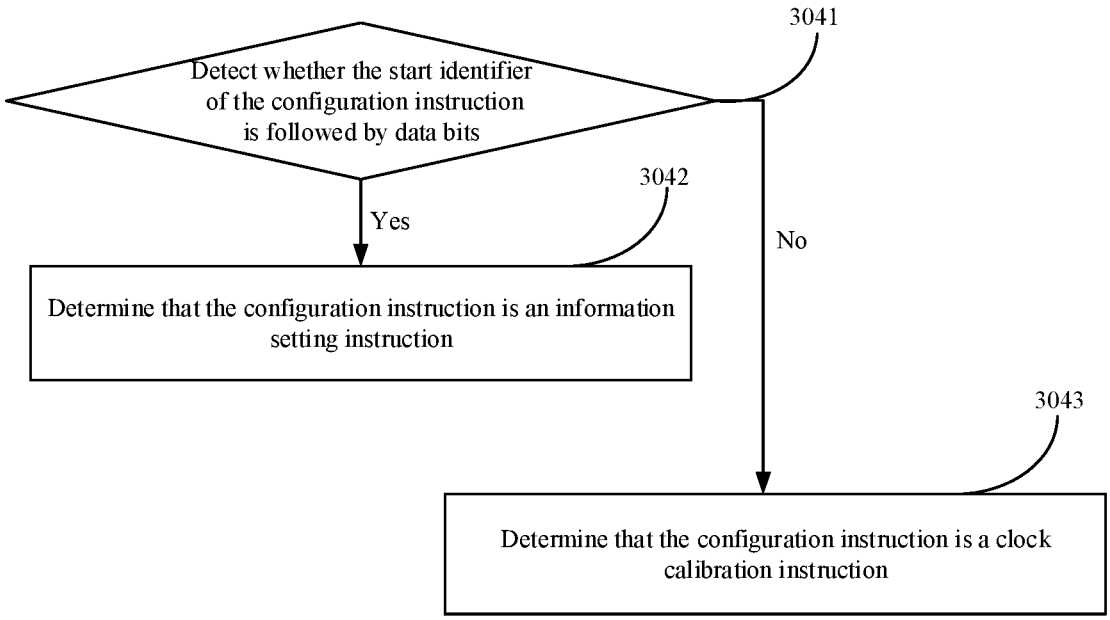
FIG. 2D is a flow chart of a method for detecting data bits of a configuration instruction according to an exemplary embodiment.

In order to determine whether the configuration instruction is an information setting instruction, the source driver performs a method of detecting data bits of the configuration instruction as shown in FIG. 2D after receiving the configuration instruction transmitted by the timing controller via the first signal line. As shown in FIG. 2D, the method of detecting the data bit of the configuration instruction may include, at step 3041, detecting whether the start identifier of the configuration instruction is followed by the data bits. When the start identifier of the configuration instruction is followed by the data bits, step 3042 is performed; when the start identifier of the configuration instruction is not followed by the data bits, step 3043 is performed.

Assuming that the format of the configuration instruction received by the source driver is as shown in FIG. 2B, with the start identifier followed by the data bits, the source driver determines that the configuration instruction is an information setting instruction. Assuming that the format of the configuration instruction received by the source driver is as shown in FIG. 2C, with the start identifier not followed by the data bits, the source driver determines that the configuration instruction is a clock calibration instruction.

Returning to FIG. 2D, the method of detecting the data bit of the configuration instruction may further include, at step 3042, determining that the configuration instruction is an information setting instruction.

When the start identifier of the configuration instruction is followed by the data bits, the source driver determines that the received configuration instruction is an information setting instruction, and the source driver extracts the setting indication data in the information setting instruction, so as to set the configuration information of the source driver according to the setting indication data.

Additionally, the method of detecting the data bit of the configuration instruction may further include, at step 3043, determining that the configuration instruction is a clock calibration instruction.

When the start identifier of the configuration instruction is not followed by the data bits, the source driver determines that the received configuration instruction is a clock calibration instruction, and the source driver determines the data received at an agreed time after receipt of the clock calibration instruction to be clock calibration data, so as to perform a clock calibration operation according to the clock calibration data.

Now return to the method shown in FIG. 2A. At step 305, the source driver sets the configuration information of the source driver according to the setting indication data.

After determining that the received configuration instruction is an information setting instruction, the source driver extracts the setting indication data in the information setting instruction, and sets the configuration information of the source driver according to the setting indication data.

In an example, the setting indication data can be used to indicate the number of channels of the ports of the source driver. In this case, after receiving the information setting instruction, the source driver can set the number of channels of the ports of the source driver according to the setting indication data in the information setting instruction. For example, the source driver can set the number of channels of its own ports to 1, 2 or 3. In this case, since there are three possibilities, these three possibilities can be expressed by, for example, 2-bit binary data. The data bits may thus include consecutive 2-bit binary data. For this example, step 305 may, for example, include:

Setting the number of channels of the ports of the source driver to a first value, x1, when the consecutive 2-bit binary data is 00;

Setting the number of channels of the ports of the source driver to a second value, x2, when the consecutive 2-bit binary data is 01; and Setting the number of channels of the ports of the source driver to a third value, x3, when the consecutive 2-bit binary data is 10 or 11, where x1, x2, and x3 are different from each other. For example, x1 can be equal to 1, x2 can be equal to 2, and x3 can be equal to 3. The values of x1, x2, and x3 are not limited in the embodiment of the present disclosure.

In another example, the setting indication data can be used to indicate a matching resistance. In this case, after receiving the information setting instruction, the source driver can set the matching resistance of the source driver according to the setting indication data in the information setting instruction. For example, the source driver can set its own matching resistor to 100 ohms, 150 ohms, or 300 ohms, etc. In this case, since there are a plurality of (e.g., six) possibilities, multiple-bit (e.g., 3-bit) binary data may be used to represent the plurality of (six) possibilities. The data bits may thus include consecutive 3-bit binary data. For this example, step 305 may, for example, include:

Setting the matching resistance of the source driver to a first value, y1 ohms, when the consecutive 3-bit binary data is 000;

Setting the matching resistance of the source driver to the second value, y2 ohms, when the consecutive 3-bit binary data is 001;

Setting the matching resistance of the source driver to a third value, y3 ohms, when the consecutive 3-bit binary data is 010;

Setting the matching resistance of the source driver to a fourth value, y4 ohms, when the consecutive 3-bit binary data is 011;

Setting the matching resistance of the source driver to a fifth value, y5 ohms, when the consecutive 3-bit binary data is 100; and Setting the matching resistance of the source driver to a sixth value, y6 ohms, when the consecutive 3-bit binary data is 101. y1, y2, y3, y4, y5, and y6 may be different from each other. For example, y1 may be equal to 100, y2 may be equal to 110, y3 may be equal to 150, y4 may be equal to 170, y5 may be equal to 300, and y6 may be equal to 400. The values of y1, y2, y3, y4, y5, and y6 are not limited in the embodiment of the present disclosure.

In yet another example, the setting indication data can be used to indicate a transmission rate. In this case, after receiving the information setting instruction, the source driver can set the transmission rate of the source driver according to the setting indication data in the information setting instruction. For example, the source driver can set its own transmission rate to 540 Mbps, 648 Mbps, etc. In this case, since there are many possibilities, multiple-bit binary data, for example, can be used to represent these multiple possibilities. Thus, the data bits may include, for example, consecutive 5-bit binary data to represent these multiple possibilities. For this example, step 305 may, for example, include:

Setting the transmission rate of the source driver to 540 Mbps when the consecutive 5-bit binary data is 00000, and the transmission rate of the source driver may be set to other values as appropriate when the consecutive 5-bit binary data is of other values. In addition, when the consecutive 5-bit binary data is 00000, the transmission rate of the source driver may also be set to other rates, which is not limited in the embodiment of the present disclosure. In an embodiment, when the consecutive 5-bit binary data is 00000, the transmission rate of the source driver is increased by 108 megabits per second each time the 00000 increases by 1-bit binary 1, and the transmission rate of the source driver does not exceed 3,456 megabits per second.

In still another example, the setting indication data can also be used to indicate a scrambling function. In this case, after receiving the information setting instruction, the source driver can determine whether to enable the scrambling function according to the setting indication data in the information setting instruction. In addition, the setting indication data can also be used to indicate signal quality configuration parameters, identity, and the like.

According to the present disclosure, the setting indication data may further be defined in any other suitable manner. For example, the number of channels of the ports of the source driver can be indicated by bit[3] and bit[4] in the first byte of the data bits. For example, when bit[3] is 0 and bit[4] is 0, the source driver sets the number of channels of the ports of the source driver port to 1; when bit[3] is 0 and bit[4] is 1, the source driver sets the number of channels of the ports of the source driver to 2; and when bit[3] is 1, the source driver sets the number of channels of the ports of the source driver to 3.

By way of example, the matching resistance of the source driver can be indicated by bit[0] to bit[2] in the second byte of the data bits. For example, when bit[0] to bit[2] is 000, the source driver sets the matching resistance of the source driver to 100 ohms; when bit[0] to bit[2] is 001, the source driver sets the matching resistance of the source driver to 110 ohms, and the like.

By way of example, the transmission rate of the source driver can be indicated by bit[0] to bit[4] in the third byte of the data bits. For example, when bit[0] to bit[4] is 00000, the source driver sets the transmission rate of the source driver to 540 Mbps; when bit[0] to bit[4] is 00001, the source driver sets the transmission rate of the source driver to 648 Mbps; when bit[0] to bit[4] is 00010, the source driver sets the transmission rate of the source driver to 756 Mbps; and when bit[0] to bit[4] is 00011, the source driver sets the transmission rate of the source driver to 864 Mbps, and the like. It should be noted that in this example, the transmission rate of the source driver generally does not exceed 3456 Mbps.

By way of example, whether scrambling function is enabled can be indicated by bit [7] in the third byte of the data bits. For example, when bit[7] is 0, the scrambling function is disabled; when bit[7] is 1, the scrambling function is enabled.

In an exemplary embodiment, since the setting of the configuration information of the source driver can be completed via the first signal line, no peripheral circuit is required to complete the setting of the configuration information of the source driver, and the peripheral circuit does not need to be provided with elements such as a resistor and a capacitor. In this way, the structure of the peripheral circuit is simpler. In addition, setting the configuration information of the source driver via the first signal line also makes the setting of the configuration information of the source driver more flexible.

Continued reference is made to the configuration information setting method as shown in FIG. 2A. At step 306, the timing controller receives a user-triggered clock calibration indication.

As described above, the timing controller can receive the user-triggered clock calibration indication in addition to the user-triggered information setting indication.

At step 307, the timing controller generates a clock calibration instruction based on the clock calibration indication.

After the timing controller receives the clock calibration indication, the timing controller generates the clock calibration instruction according to the clock calibration indication, and the format of the clock calibration instruction may be as shown in FIG. 2C. The clock calibration instruction includes a preamble, a start identifier, and an end identifier that are sequentially arranged. By way of example, the preamble can be obtained by Manchester coding of consecutive 8-bit binary 0s. The start identifier includes consecutive 2-bit binary 0s. The end identifier includes consecutive 2-bit binary 1s.

It should be noted that, just like the information setting instruction, the identity of the source driver on which a corresponding operation is to be performed can be transmitted together with the clock calibration instruction. After the source driver receives a signal transmitted by the timing controller, it can detect whether the identity in the signal is the same as its own identity. When the identity in the signal is the same as its own identity, the source driver performs the corresponding operation, such as performing a clock calibration. When the identity in the signal is not the same as its own identity, the source driver does not perform the operation. The identity of the source driver is agreed on and configured in advance by the timing controller and the source driver.

At step 308, the timing controller sequentially transmits the clock calibration instruction and the clock calibration data to the source driver via the first signal line.

In an exemplary embodiment, the timing controller sequentially transmits the clock calibration instruction and the clock calibration data to the source driver via the first signal line in order to complete the clock calibration operation and reduce the error rate of data transmission. The duration of the interval between transmitting of the clock calibration instruction and the clock calibration data by the timing controller is preset by the timing controller and the source driver.

Figure 2E:
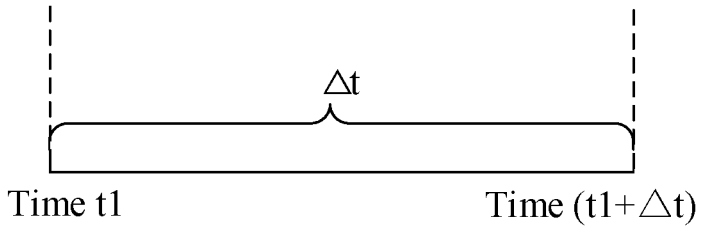
FIG. 2E is a schematic diagram of timing for receiving a clock calibration instruction and clock calibration data according to an exemplary embodiment.

For the source driver, when the configuration instruction is a clock calibration instruction, the source driver determines the data received at an agreed time after receipt of the clock calibration instruction to be the clock calibration data. The agreed time is determined according to the duration of the interval between transmitting of the clock calibration instruction and the clock calibration data by the timing controller. By way of example, as shown in FIG. 2E, the duration of the interval between transmitting of the clock calibration instruction and the transmission clock calibration data by the timing controller is $\Delta t$. Given that the source driver receives the clock calibration instruction at time $t1$, the source driver will determine the data received at time $(t1+\Delta t)$ to be the clock calibration data, and the time $(t1+\Delta t)$ is the agreed time. Upon receipt of the clock calibration data, the source driver can perform a clock calibration operation based on the clock calibration data. Reference may be made to related art for the description of the clock calibration data, the details of which are not described herein.

Continued reference is made to the configuration information setting method as shown in FIG. 2A. At step 309, the source driver performs the clock calibration operation based on the clock calibration data.

In an exemplary embodiment, the timing controller sequentially transmits the clock calibration instruction and clock calibration data to the source driver via the first signal line, with the clock calibration instruction not including the data bits. When the source driver receives the clock calibration instruction, it determines the data received at the agreed time after receipt of the clock calibration instruction to be the clock calibration data, and then performs the clock calibration operation. This process enables the source driver to quickly enter the clock calibration phase, resulting in faster clock calibration. Reference may be made to related art for a specific process of performing the clock calibration operation according to the clock calibration data.

The configuration information setting method provided by exemplary embodiments is such that the peripheral circuit does not need to complete the setting of the configuration information of the source driver, and the peripheral circuit does not need to be provided with elements such as a resistor and a capacitor. This simplifies the structure of the peripheral circuits and enhances the versatility of the source drivers, making the setting of the configuration information of the source drivers more flexible. In addition, the configuration information setting method provided by exemplary embodiments also enables the source driver to quickly enter the clock calibration phase, shortening the time required for clock calibration.

It should be noted that the sequence of the steps of the configuration information setting method provided by exemplary embodiments may be adjusted as appropriate, and the steps may also be increased or decreased correspondingly according to the situation. For example, the processes of steps 301 to 305 can be interchanged with the processes of steps 306 to 309. Any method that can be easily conceived by those skilled in the art within the technical scope of the present application is intended to be encompassed in the scope of the present application and therefore will not be described.

Figure 3A:
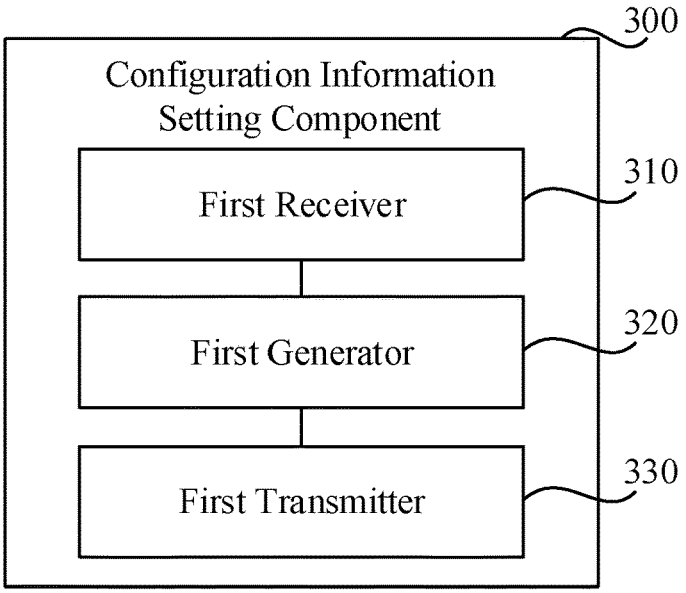
FIG. 3A is a schematic diagram of a structure of a configuration information setting component according to an exemplary embodiment.

FIG. 3A illustrates a configuration information setting component 300 provided by an exemplary embodiment. This component is used, for example, in the timing controller 100 as shown in FIG. 1A. As shown in FIG. 3A, the configuration information setting component 300 includes a first receiver 310 for receiving a user-triggered information setting indication. The configuration information setting component 300 may further include a first generator 320 for generating, according to the information setting indication, an information setting instruction including setting indication data, with the setting indication data being used to instruct the source driver to set the configuration information of the source driver according to the setting indication data. The configuration information setting component 300 may further include a first transmitter 330 for transmitting the information setting instruction to the source driver via the first signal line.

Figure 3B:
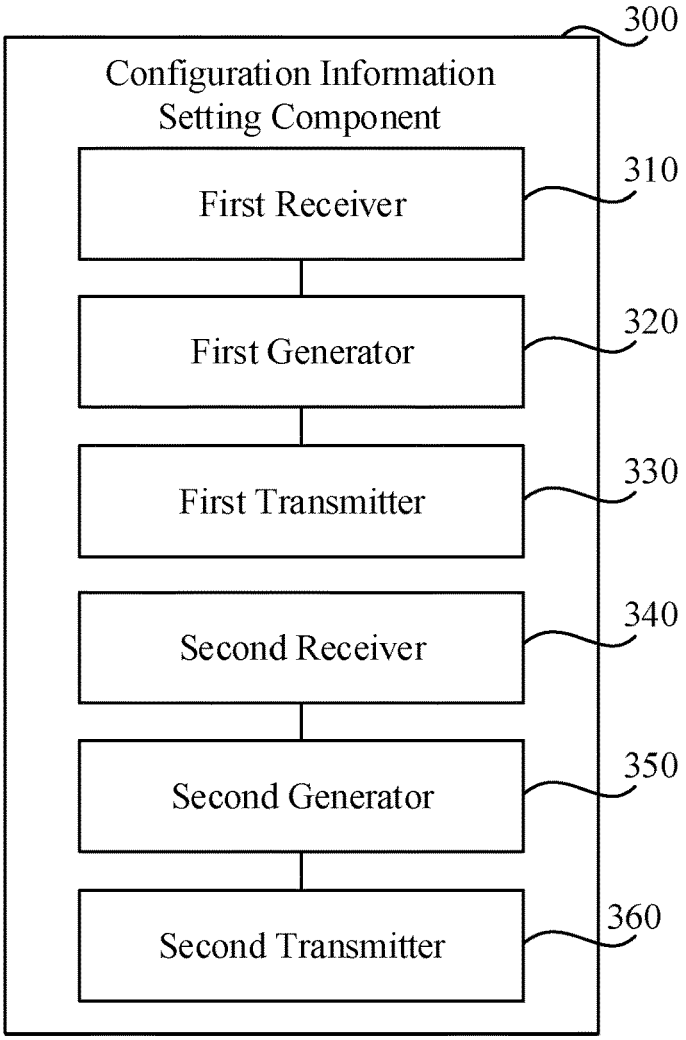
FIG. 3B is a schematic diagram of a structure of another configuration information setting component according to an exemplary embodiment.

FIG. 3B illustrates another configuration information setting component 300 provided by an exemplary embodiment. This component is used, for example, in the timing controller 100 as shown in FIG. 1A. The configuration information setting component 300 may further include a second receiver 340 for receiving a user-triggered clock calibration indication, in addition to the first receiver 310, the first generator 320, and the first transmitter 330 shown in FIG. 3A. Moreover, the configuration information setting component 300 may further include a second generator 350 for generating a clock calibration instruction according to the clock calibration indication. Further, the configuration information setting component 300 may further include a second transmitter 360 for sequentially transmitting the clock calibration instruction and clock calibration data to the source driver via the first signal line, so that the source driver performs the clock calibration operation according to the clock calibration data.

In an exemplary embodiment, each of the configuration instructions may include a preamble, a start identifier, and an end identifier that are sequentially arranged, and the configuration instructions may include, for example, an information setting instruction or a clock calibration instruction.

The preamble is used to instruct the receiving end to perform clock and phase calibration, the start identifier is used to indicate the start of data transmission, and the end identifier is used to indicate the end of the data transmission.

Data bits may further be provided between the start identifier and the end identifier in the information setting instruction, and the data bits are used to carry the setting indication data.

By way of example, the preamble is obtained by Manchester coding of consecutive at least 8-bit binary 0s. The starting identifier includes consecutive at least 2-bit binary 0s. The data carried by the data bits is data obtained by Manchester coding. The end identifier includes consecutive 2-bit binary 1s.

In an exemplary embodiment, the setting indication data is used to indicate at least one of the number of channels of ports, the matching resistance, the transmission rate, or the like of the source driver.

In summary, the configuration information setting component provided by the embodiment of the present disclosure can transmit the information setting instruction to the source driver via the first signal line, so that the source driver sets the configuration information of the source driver according to the setting indication data. Therefore, the peripheral circuit does not need to complete the setting of the configuration information of the source driver and the peripheral circuit does not need to be provided with elements such as a resistor and a capacitor, thereby simplifying the structure of the peripheral circuit.

Figure 4A:
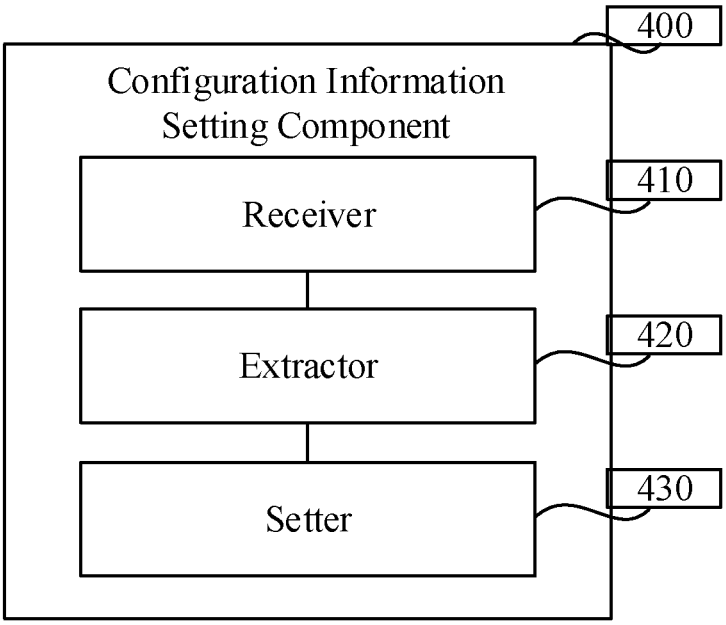
FIG. 4A is a schematic diagram of a structure of a configuration information setting component according to an exemplary embodiment.

FIG. 4A illustrates a configuration information setting component 400 provided by an exemplary embodiment. This component is used, for example, in the source driver 200 as shown in FIG. 1A. As shown in FIG. 4A, the configuration information setting component 400 may include a receiver 410 for receiving a configuration instruction transmitted by the timing controller via the first signal line. The configuration information setting component 400 may include an extractor 420 for extracting setting indication data in the information setting instruction when the configuration instruction is an information setting instruction, with the setting indication data being used to instruct the source driver to set the configuration information of the source driver according to the setting indication data. The configuration information setting component 400 may include a setter 430 for setting the configuration information of the source driver according to the setting indication data.

In summary, the configuration information setting component 400 provided by exemplary embodiments receives the configuration instruction transmitted by the timing controller via the first signal line, extracts the setting indication data when the configuration instruction is the information setting instruction, and then set the configuration information of the source driver according to the setting indication data. The component 400 eliminates the need for the peripheral circuit to complete the setting of the configuration information of the source driver, and the peripheral circuit does not need to be provided with elements such as a resistor and a capacitor, thereby simplifying the structure of the peripheral circuit.

In an exemplary embodiment, the configuration instruction may include a preamble, a start identifier, and an end identifier that are sequentially arranged. The preamble is used to instruct the receiving end to perform the clock and phase calibration. The start identifier is used to indicate the start of data transmission. The end identifier is used to indicate the end of the data transmission.

Figure 4B:
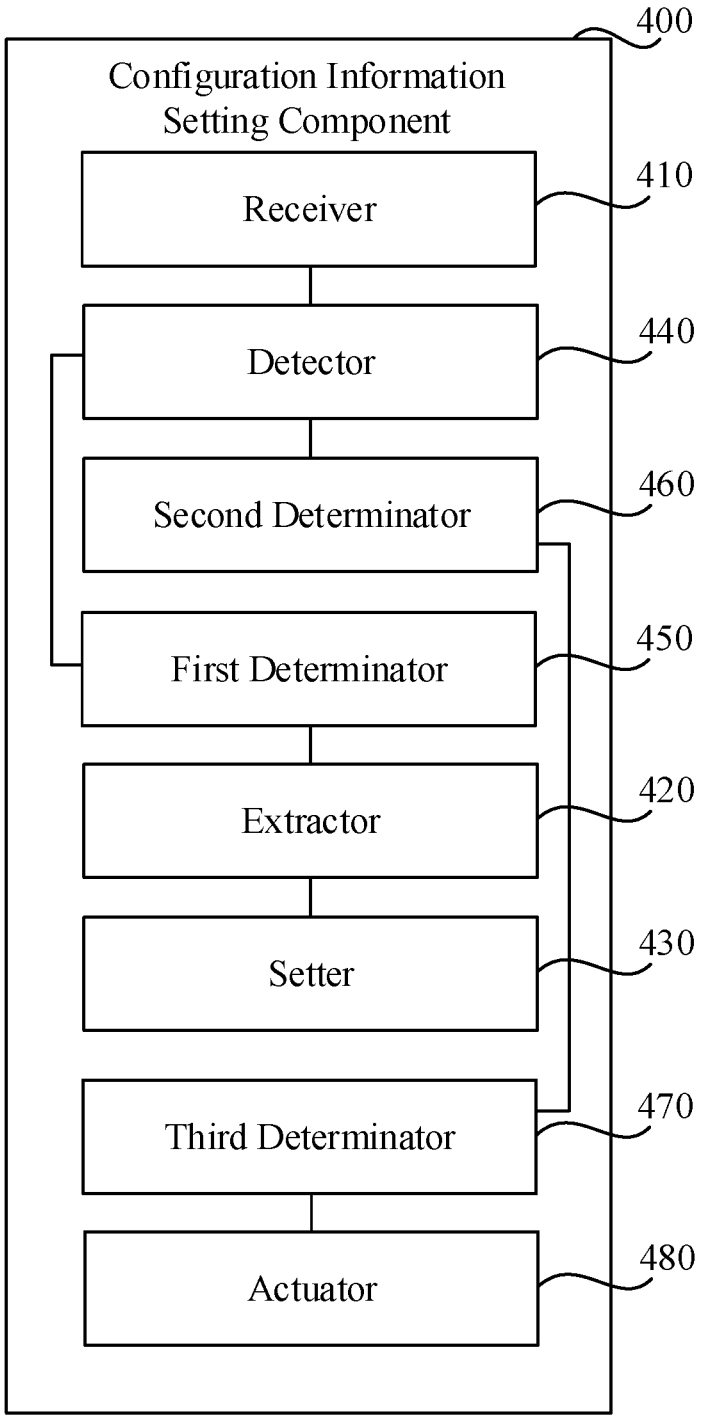
FIG. 4B is a schematic diagram of a structure of another configuration information setting component according to an exemplary embodiment.

FIG. 4B illustrates another configuration information setting component 400 provided by an exemplary embodiment. This component is used, for example, in the source driver 200 as shown in FIG. 1A. In addition to the receiver 410, the extractor 420, and the setter 430 shown in FIG. 4A, the configuration information setting component 400 may further include, as shown in FIG. 4B, a detector 440 for detecting whether the start identifier of the configuration instruction is followed by the data bits, with the data bits being used to carry the setting indication data. In addition, the configuration information setting component 400 may further include a first determinator 450 for determining that the configuration instruction is an information setting instruction when it is detected that the start identifier of the configuration instruction is followed by the data bits. The configuration information setting component 400 may further include a second determinator 460 for determining that the configuration instruction is a clock calibration instruction when it is detected that the start identifier of the configuration instruction is not followed by the data bits. Further, as shown in FIG. 4B, the configuration information setting component 400 may further include a third determinator 470 for determining data received at an agreed time after receipt of the clock calibration instruction as a clock calibration data when the configuration instruction is a clock calibration instruction. The configuration information setting component 400 may further include an actuator 480 for performing a clock calibration operation according to the clock calibration data.

In an exemplary embodiment, the setting indication data can be used, for example, to indicate the number of channels of the ports of the source driver, with the data bits including, for example, consecutive 2-bit binary data. In this case, the setter 430 can be used to set the number of channels of the ports of the source driver to x1 when the consecutive 2-bit binary data is 00, to set the number of channels of the ports of the source driver to x2 when the consecutive 2-bit binary data is 01, and to set the number of channels of the ports of the source driver to x3 when the consecutive 2-bit binary data is 10 or 11, where x1, x2 and x3 are different from each other.

In an exemplary embodiment, the setting indication data may further be used, for example, to indicate the matching resistance, with the data bits including, for example, consecutive 3-bit binary data. In this case, the setter 430 is used to set the matching resistance of the source driver to y1 ohms when the consecutive 3-bit binary data is 000, to set the matching resistance of the source driver to y2 ohms when the consecutive 3-bit binary data is 001, to set the matching resistance of the source driver to y3 ohms when the consecutive 3-bit binary data is 010, to set the matching resistance of the source driver to y4 ohms when the consecutive 3-bit binary data is 011, to set the matching resistance of the source driver to y5 ohms when the consecutive 3-bit binary data is 100, and to set the matching resistance of the source driver to y6 ohms when the consecutive 3-bit binary data is 101, where y1, y2, y3, y4, y5, and y6 are different from each other.

In an exemplary embodiment, the setting indication data may further be used, for example, to indicate the transmission rate, with the data bits including, for example, consecutive 5-bit binary data. In this case, the setter 430 is used to set the transmission rate of the source driver to 540 megabits per second when the consecutive 5-bit binary data is 00000, and to set the transmission rate of the source driver to a different value when the consecutive 5-bit binary data is of other binary values. In an embodiment, when the consecutive 5-bit binary data is 00000, the transmission rate of the source driver is increased by 108 megabits per second each time the 00000 increases by 1-bit binary 1, and the transmission rate of the source driver does not exceed 3,456 megabits per second.

In summary, the configuration information setting component provided by exemplary embodiments receives the configuration instruction transmitted by the timing controller via the first signal line, extracts the setting indication data when the configuration instruction is the information setting instruction, and then set the configuration information of the source driver according to the setting indication data. This component eliminates the need for the peripheral circuit to complete the setting of the configuration information of the source driver, and the peripheral circuit does not need to be provided with elements such as a resistor and a capacitor, thereby simplifying the structure of the peripheral circuit. In addition, an exemplary embodiment further provides a display device including a timing controller and a source driver. In an exemplary embodiment, the timing controller may include, for example, the configuration information setting component illustrated in FIG. 3A or 3B. The source driver may include the configuration information setting component shown in FIG. 4A or 4B.

The display device may be any product or component that has a display function, such as a liquid crystal panel, an electronic paper, an organic light-emitting diode (OLED) panel, a mobile phone, a tablet computer, a television (e.g., a liquid crystal television including a backlight brightness control unit), a display, a notebook computer, digital photo frame, and navigator.

An exemplary embodiment further provides a computer-readable storage medium having stored therein computer readable instructions. When the computer readable instructions are executed on a computer, the computer is caused to perform the configuration information setting method as shown in FIG. 1C or 2A.

An exemplary embodiment further provides a computer-readable storage medium having stored therein computer readable instructions. When the computer readable instructions are executed on a computer, the computer is caused to perform the configuration information setting method as shown in FIG. 1D or 2A.

A person skilled in the art can clearly understand that for the convenience and brevity of the description, reference can be made to corresponding processes in the foregoing method embodiments for the specific operation process of the foregoing apparatus and components, the details of which are not described herein again.

It should be noted that the connection relationship between the devices shown in the drawings of the present disclosure is exemplary. Those skilled in the art can connect any of the devices together as appropriate.

Other implementations of the present application will be readily conceived by those skilled in the art after taking into account the specification and practicing the disclosure disclosed herein. The application is intended to cover any variations, uses, or adaptations of the application, which are in accordance with the general principles of the application and include common general knowledge or conventional technical means in the art that are not disclosed herein. The specification and embodiments are to be regarded as illustrative only, and the true scope and spirit of the present application is designated by the claims.

It is to be understood that the present application is not limited to the detailed structures that have been described above and shown in the drawings, and that various modification and changes can be made without departing from the scope thereof. The scope of the present application is limited only by the appended claims.

What is claimed is:

1. A configuration information setting method for a source driver, the source driver being connected to a timing controller via a first signal line, the method comprising:

receiving, via the first signal line, a configuration instruction transmitted by the timing controller;

extracting, when the configuration instruction is an information setting instruction, setting indication data in the information setting instruction, wherein the setting indication data is configured to instruct the source driver to set configuration information of the source driver according to the setting indication data; and setting the configuration information of the source driver according to the setting indication data, wherein, the configuration instruction comprises a preamble, a start identifier and an end identifier that are sequentially arranged, the preamble is configured to instruct a receiving end to perform clock and phase calibration, the start identifier is configured to indicate a start of data transmission, and the end identifier is configured to indicate an end of the data transmission, and the method further comprises, after the receiving via the first signal line the configuration instruction transmitted by the timing controller;

detecting whether the start identifier of the configuration instruction is followed by data bits, wherein the data bits are configured to carry the setting indication data;

determining that the configuration instruction is an information setting instruction when the start identifier of the configuration instruction is followed by the data bits; and determining that the configuration instruction is a clock calibration instruction when the start identifier of the configuration instruction is not followed by the data bits, wherein, the setting indication data is configured to indicate a number of channels of ports of the source driver, and the data bits comprise consecutive 2-bit binary data, and the setting the configuration information of the source driver according to the setting indication data comprises:

setting the number of channels of the ports of the source driver to a first value when the consecutive 2-bit binary data is 00;

setting the number of channels of the ports of the source driver to a second value when the consecutive 2-bit binary data is 01; and setting the number of channels of the ports of the source driver to a third value when the consecutive 2-bit binary data is 10 or 11, wherein the first value the second value and the third value are different from each other.

2. The method of claim 1, further comprising:

determining data received at an agreed time after receipt of the clock calibration instruction to be clock calibration data when the configuration instruction is a clock calibration instruction; and performing a clock calibration operation according to the clock calibration data.

3. A non-transitory computer-readable storage medium having stored therein instructions that, when executed on a computer, cause the computer to perform the configuration information setting method of claim 1.

4. The method of claim 1, wherein each of the information setting instruction and the clock calibration instruction comprises a preamble, a start identifier and an end identifier that are sequentially arranged, the preamble is configured to instruct a receiving end to perform clock and phase calibration, the start identifier is configured to indicate a start of data transmission, and the end identifier is configured to indicate an end of the data transmission, and data bits are further provided between the start identifier and the end identifier in the information setting instruction, and the data bits are configured to carry the setting indication data.

5. The method of claim 1, wherein the preamble is obtained by Manchester coding of consecutive at least 8-bit binary 0s, the starting identifier comprises consecutive 2-bit binary 0s, data carried by the data bits is data obtained by Manchester coding, and the end identifier comprises consecutive 2-bit binary 1s.

6. A configuration information setting method for a source driver, the source driver being connected to a timing controller via a first signal line, the method comprising:

receiving, via the first signal line, a configuration instruction transmitted by the timing controller;

extracting, when the configuration instruction is an information setting instruction, setting indication data in the information setting instruction, wherein the setting indication data is configured to instruct the source driver to set configuration information of the source driver according to the setting indication data; and setting the configuration information of the source driver according to the setting indication data, wherein, the configuration instruction comprises a preamble, a start identifier and an end identifier that are sequentially arranged, the preamble is configured to instruct a receiving end to perform clock and phase calibration, the start identifier is configured to indicate a start of data transmission, and the end identifier is configured to indicate an end of the data transmission, and the method further comprises, after the receiving via the first signal line the configuration instruction transmitted by the timing controller:

detecting whether the start identifier of the configuration instruction is followed by data bits, wherein the data bits are configured to carry the setting indication data;

determining that the configuration instruction is an information setting instruction when the start identifier of the configuration instruction is followed by the data bits; and determining that the configuration instruction is a clock calibration instruction when the start identifier of the configuration instruction is not followed by the data bits, wherein the setting indication data is configured to indicate a matching resistance, and the data bits comprise consecutive 3-bit binary data, and the setting the configuration information of the source driver according to the setting indication data comprises:

setting the matching resistance of the source driver to a first value when the consecutive 3-bit binary data is 000;

setting the matching resistance of the source driver to a second value when the consecutive 3-bit binary data is 001;

setting the matching resistance of the source driver to a third value when the consecutive 3-bit binary data is 010;

setting the matching resistance of the source driver to a fourth value when the consecutive 3-bit binary data is 011;

setting the matching resistance of the source driver to a fifth value when the consecutive 3-bit binary data is 100; and setting the matching resistance of the source driver to a sixth value when the consecutive 3-bit binary data is 101, wherein the first value, the second value, the third value, the fourth value, the fifth value, and the sixth value are different from each other.

7. The method of claim 6, further comprising:

determining data received at an agreed time after receipt of the clock calibration instruction to be clock calibration data when the configuration instruction is a clock calibration instruction; and performing a clock calibration operation according to the clock calibration data.

8. The method of claim 6, wherein each of the information setting instruction and the clock calibration instruction comprises a preamble, a start identifier and an end identifier that are sequentially arranged, the preamble is configured to instruct a receiving end to perform clock and phase calibration, the start identifier is configured to indicate a start of data transmission, and the end identifier is configured to indicate an end of the data transmission, and data bits are further provided between the start identifier and the end identifier in the information setting instruction, and the data bits are configured to carry the setting indication data.

9. The method of claim 6, wherein the preamble is obtained by Manchester coding of consecutive at least 8-bit binary 0s, the starting identifier comprises consecutive 2-bit binary 0s, data carried by the data bits is data obtained by Manchester coding, and the end identifier comprises consecutive 2-bit binary 1s.

10. A non-transitory computer-readable storage medium having stored therein instructions that, when executed on a computer, cause the computer to perform the configuration information setting method of claim 6.

11. A configuration information setting method for a source driver, the source driver being connected to a timing controller via a first signal line, the method comprising:

receiving, via the first signal line, a configuration instruction transmitted by the timing controller;

extracting, when the configuration instruction is an information setting instruction, setting indication data in the information setting instruction, wherein the setting indication data is configured to instruct the source driver to set configuration information of the source driver according to the setting indication data; and setting the configuration information of the source driver according to the setting indication data, wherein, the configuration instruction comprises a preamble, a start identifier and an end identifier that are sequentially arranged, the preamble is configured to instruct a receiving end to perform clock and phase calibration, the start identifier is configured to indicate a start of data transmission, and the end identifier is configured to indicate an end of the data transmission, and the method further comprises, after the receiving via the first signal line the configuration instruction transmitted by the timing controller:

detecting whether the start identifier of the configuration instruction is followed by data bits, wherein the data bits are configured to carry the setting indication data;

determining that the configuration instruction is an information setting instruction when the start identifier of the configuration instruction is followed by the data bits; and determining that the configuration instruction is a clock calibration instruction when the start identifier of the configuration instruction is not followed by the data bits, wherein, the setting indication data is configured to indicate a transmission rate, and the data bits comprise consecutive 5-bit binary data, and the setting the configuration information of the source driver according to the setting indication data comprises:

setting the transmission rate of the source driver to 540 megabits per second when the consecutive 5-bit binary data is 00000, and increasing the transmission rate of the source driver by 108 megabits per second each time the 00000 increases by 1-bit binary 1, wherein the transmission rate of the source driver does not exceed 3,456 megabits per second.

12. The method of claim 11, further comprising:

determining data received at an agreed time after receipt of the clock calibration instruction to be clock calibration data when the configuration instruction is a clock calibration instruction; and performing a clock calibration operation according to the clock calibration data.

13. The method of claim 11, wherein each of the information setting instruction and the clock calibration instruction comprises a preamble, a start identifier and an end identifier that are sequentially arranged, the preamble is configured to instruct a receiving end to perform clock and phase calibration, the start identifier is configured to indicate a start of data transmission, and the end identifier is configured to indicate an end of the data transmission, and data bits are further provided between the start identifier and the end identifier in the information setting instruction, and the data bits are configured to carry the setting indication data.

14. The method of claim 11, wherein the preamble is obtained by Manchester coding of consecutive at least 8-bit binary 0s, the starting identifier comprises consecutive 2-bit binary 0s, data carried by the data bits is data obtained by Manchester coding, and the end identifier comprises consecutive 2-bit binary 1s.

15. A non-transitory computer-readable storage medium having stored therein instructions that, when executed on a computer, cause the computer to perform the configuration information setting method of claim 11.

* * * * *